US006575805B1

(12) United States Patent
Ansolabehere et al.

(10) Patent No.: US 6,575,805 B1
(45) Date of Patent: Jun. 10, 2003

(54) NON-LATEX CENTERPIECE BALLOON

(75) Inventors: Paul A. Ansolabehere, Minnetonka, MN (US); Joseph A. Bourgeault, Minnetonka, MN (US); Robert E. Greenwald, Coon Rapids, MN (US); Robert E. Yedowitz, Jr., Tuckahoe, NY (US)

(73) Assignee: Anagram International, Inc., Minneapolis, MN (US)

( * ) Notice: Subject to any disclaimer, the term of this patent is extended or adjusted under 35 U.S.C. 154(b) by 0 days.

(21) Appl. No.: 10/208,592

(22) Filed: Jul. 30, 2002

(51) Int. Cl.[7] ..... A63H 3/06

(52) U.S. Cl. ..... 446/220; 446/221; 446/226; 40/214

(58) Field of Search ..... 446/220–226; 40/212, 214; 156/145, 61; 206/522; 428/11–13, 24–26; D21/440; 472/134

(56) References Cited

U.S. PATENT DOCUMENTS 1,714,558 A * 5/1929 Hauff
3,398,501 A * 8/1968 Aninger
4,077,588 A 3/1978 Hurst
4,290,763 A 9/1981 Hurst
4,778,431 A 10/1988 Dudley
4,917,646 A 4/1990 Kieves
5,023,118 A * 6/1991 Cheng ..... 428/24
5,108,339 A 4/1992 Kieves
5,480,029 A * 1/1996 Batsford ..... 206/522
5,769,685 A * 6/1998 Nakamura et al. ..... 446/221
D406,787 S * 3/1999 Kan ..... D11/118
6,332,823 B1 * 12/2001 Rouse, Jr. ..... 446/220
6,398,029 B1 * 6/2002 Farison et al. ..... 206/522

OTHER PUBLICATIONS

Inflatable centerpiece product shown in Exhibits A–C.
Inflatable centerpiece product shown in Exhibit D.
Inflatable centerpiece product shown in Exhibit E.

* cited by examiner

*Primary Examiner*—Derris H. Banks
*Assistant Examiner*—Jamila Williams
(74) *Attorney, Agent, or Firm*—McDonnell Boehnen Hulbert & Berghoff

(57) ABSTRACT

A non-latex balloon is shown and includes an inflatable inner portion. Inflatable outer portions communicate with the inner portion and are secured thereto in an assembled state to provide a substantially vertical message face.

2 Claims, 5 Drawing Sheets

NON-LATEX CENTERPIECE BALLOON

BACKGROUND OF THE INVENTION

The present invention relates generally to an inflatable balloon structure and more particularly a non-latex, or metallic-coated, balloon for use as a centerpiece.

Non-latex balloons were introduced many years ago. The original designs, formed by heat-sealing two flexible plastic sheets (as aptly described in U.S. Pat. No. 4,077,588) were simple circle and heart shapes. Recently the designs have become more detailed and complex, such that the appearance and characteristics of the non-latex balloon structure are well beyond a basic shape.

For example, an animal-like structure is shown in U.S. Pat. No. 4,778,431. In U.S. Pat. No. 5,108,339, a first balloon, in the shape of a bear, is encompassed in a second, heart-shaped balloon. In a third patent, U.S. Pat. No. 4,290,763, multiple plastic sheets or panels (i.e., more than two) are utilized to produce a more life-like appearance in the balloon structure.

The teachings of the aforementioned four U.S. patents are incorporated herein by reference.

SUMMARY OF THE INVENTION

In a principal aspect, the present invention is a non-latex balloon having flat, inflated and assembled states. The balloon includes an inflatable inner portion and at least two inflatable outer portions, which are in fluid communication with the inner portion via two respective umbilical portions. (As used herein, the term "communicate" and derivatives thereof refer to fluid communication.) In the flat, or non-inflated, state, the umbilical portions extend outwardly from the inner portion; in the assembled state, the umbilical portions are folded, such that the outer portions may be secured to inner portion. In the assembled state, a decorated face of each outer portion is exposed in a substantially vertical orientation.

It is thus an object of the present invention to provide a novel non-latex balloon structure having the appearance of a centerpiece. Another object is an inflatable centerpiece balloon that is readily and inexpensively mass-produced. Still another object is a non-latex balloon, having a centerpiece configuration, which is inflatable through a single port or passageway.

These and other features, objects and advantages of the present invention are described or implicit in the following detailed description of certain preferred embodiments.

BRIEF DESCRIPTION OF THE DRAWING

Various preferred embodiments of the present invention are described herein with reference to the drawing wherein.

DETAILED DESCRIPTION OF VARIOUS PREFERRED EMBODIMENTS

Figure 2:
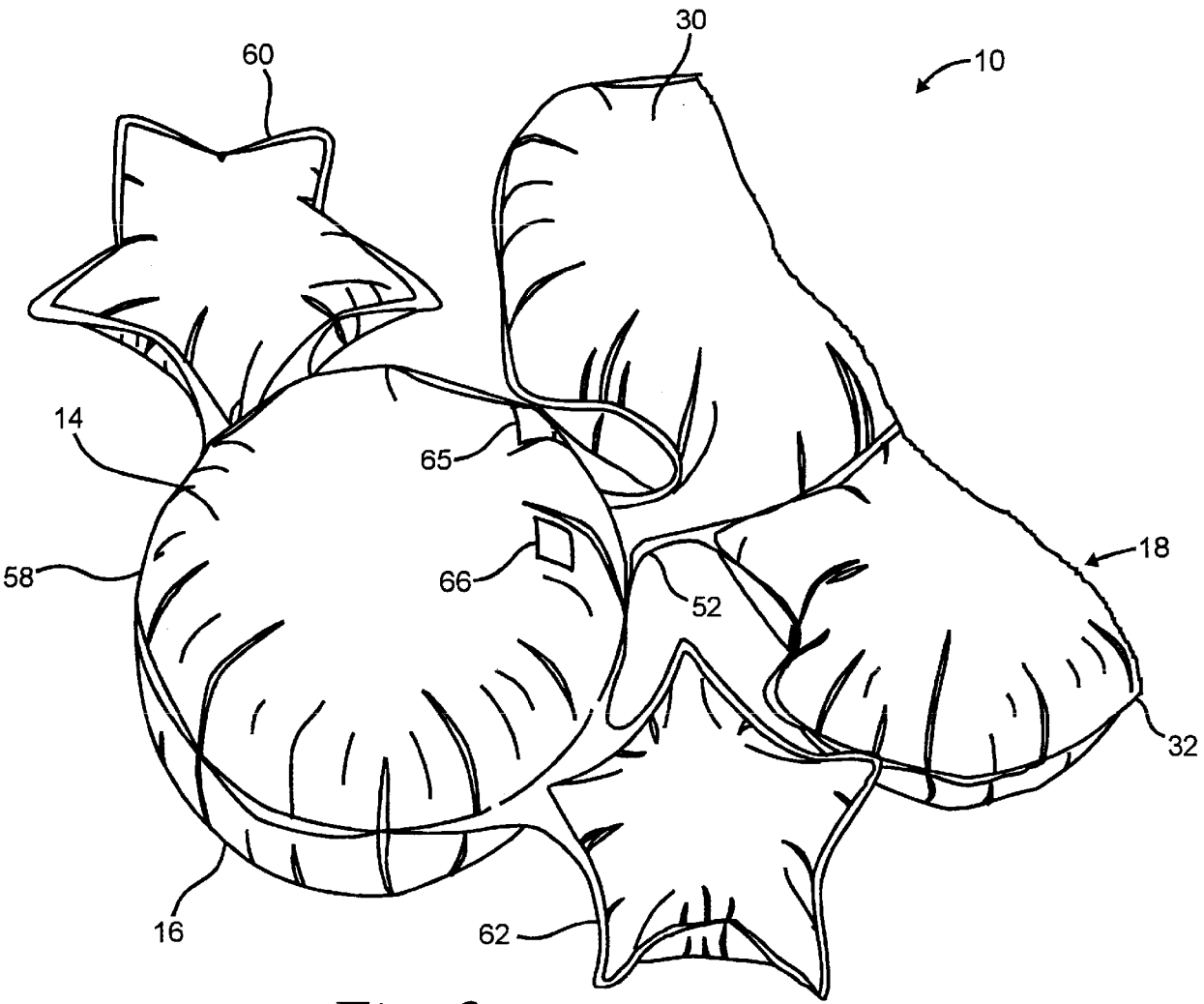
FIG. 2 is a partial perspective view illustrating the embodiment of FIG. 1 in the inflated state.
Figure 3:
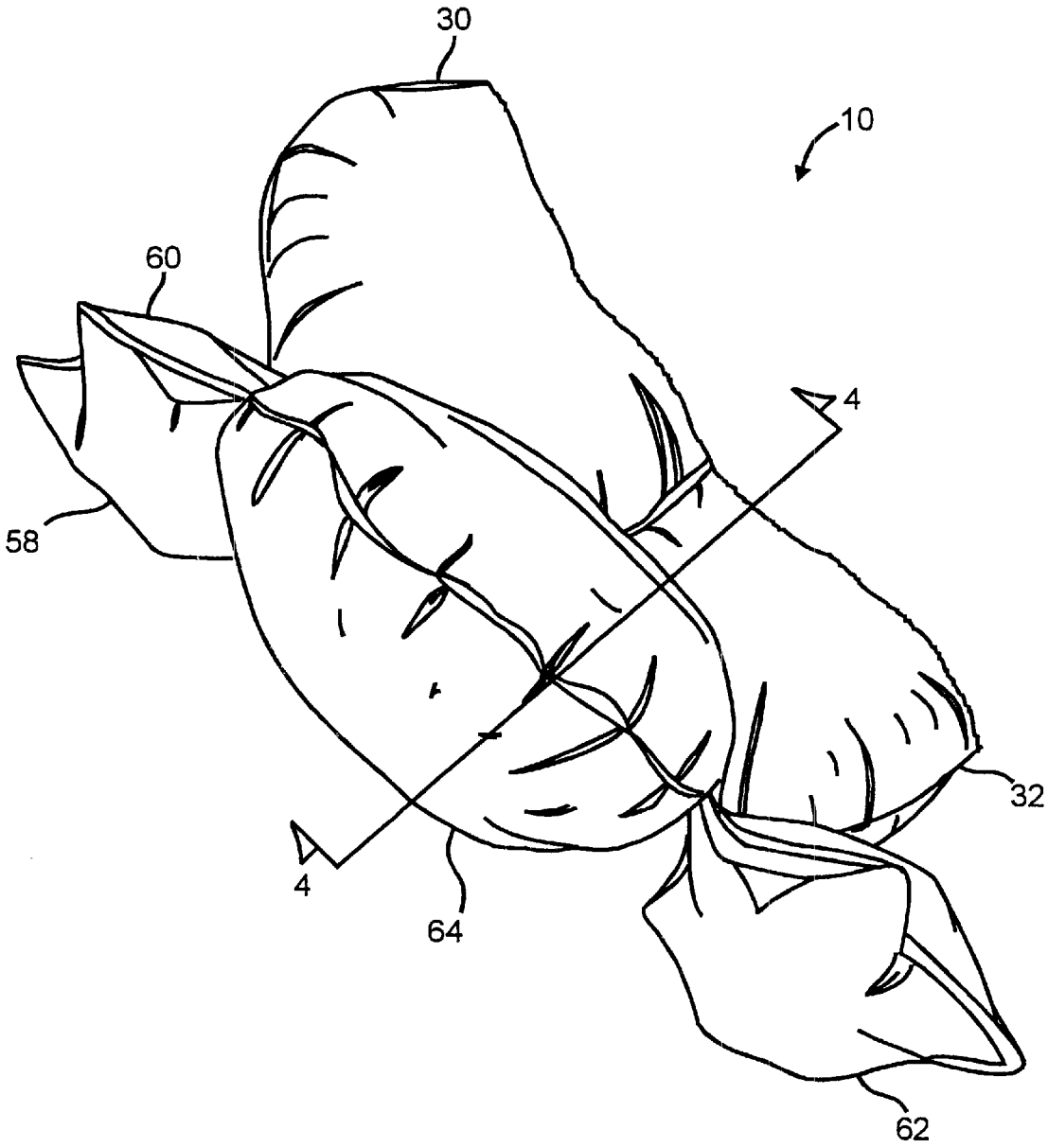
FIG. 3 is a partial perspective view illustrating the embodiment of FIG. 1 in the assembled state.
Figure 4:
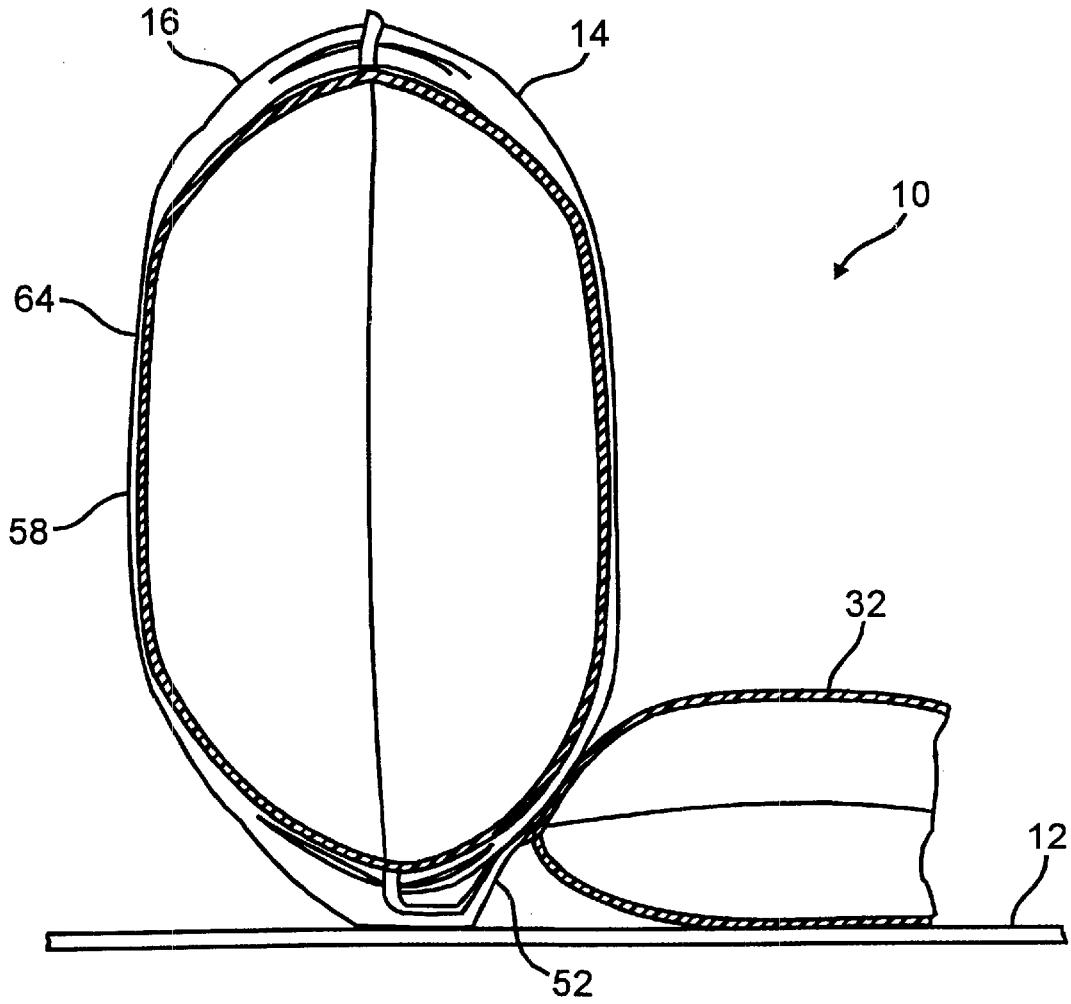
FIG. 4 is a partial cross-sectional view taken along 4—4 in FIG. 3.

With reference to FIGS. 1–4, an inflatable non-latex balloon structure is shown and generally designated 10. The balloon structure 10 has the appearance of a centerpiece. For example, the balloon structure 10 may have a birthday theme, for presentation as a table centerpiece. As used herein, descriptive terms, such as "vertical" and "horizontal," are in relation to the balloon structure 10 as situated on a tabletop 12 as shown in FIG. 4.

Figure 1:
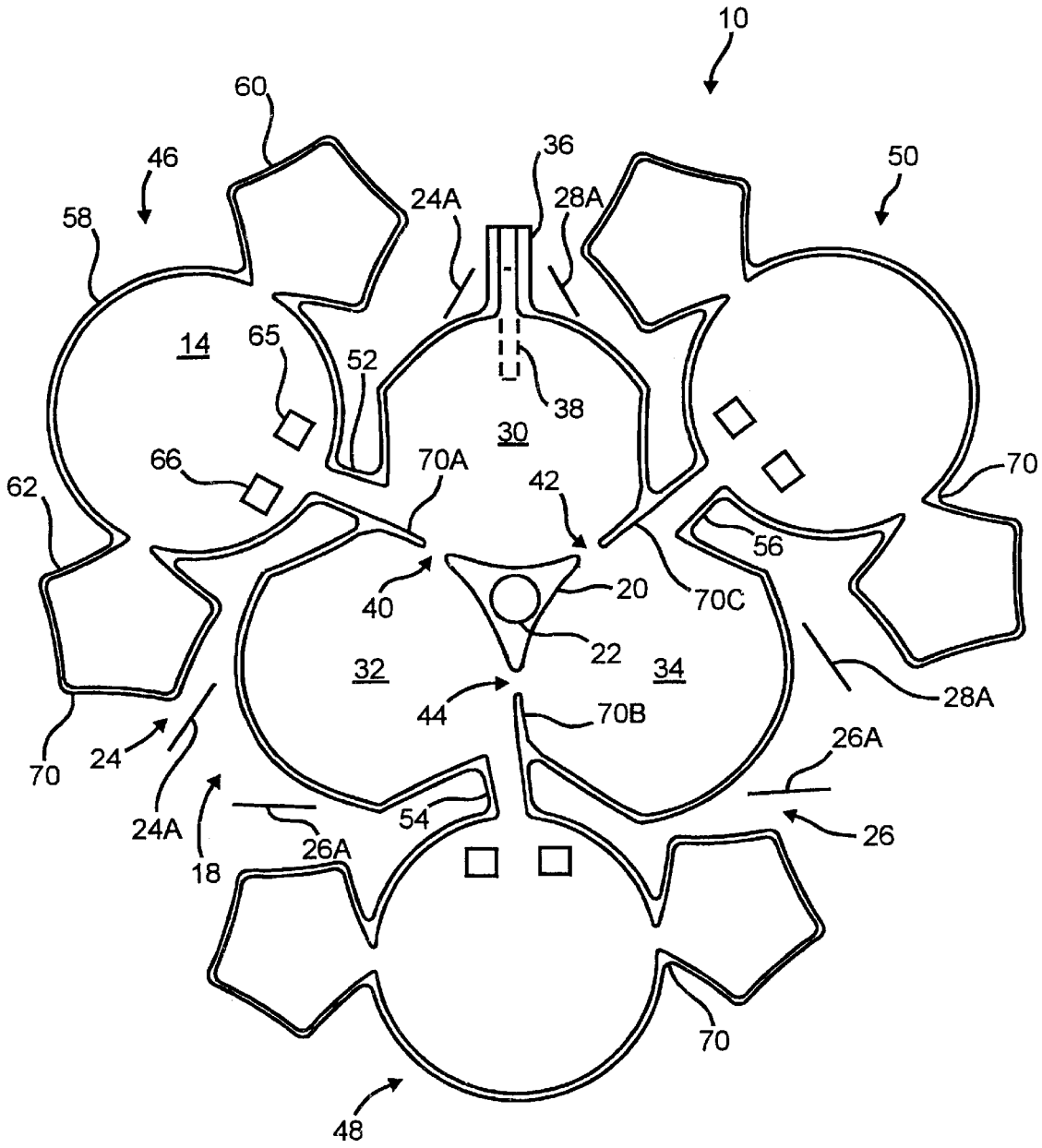
FIG. 1 is a top view illustrating a preferred embodiment of the present invention in the flat state.

The balloon structure 10 has a flat state, an inflated state and an assembled state. The flat state is shown in FIG. 1, and the features of the balloon structure 10 will be described with primary reference thereto. In the inflated state, the balloon structure 10 is filled with air, as shown in FIG. 2. The assembled state is shown in FIGS. 3 and 4, as described herein.

The balloon structure 10 is preferably an integral structure, fabricated by heat-sealing two flexible sheets of plastic 14, 16, as is well known in the art. The balloon structure 10 includes an inflatable inner portion 18. In this preferred embodiment, the inner portion 18 has a substantially triangular configuration and a central, substantially triangular region 20, wherein the plastic sheets 14, 16 are fused together. A central aperture 22 is punched in the region 20, which is adapted to receive a decorative device (not shown) such as a centerpiece cascade. In the inflated and assembled states, the inner portion 18 defines first, second and third substantially vertical faces, generally designated 24, 26, 28 and approximated by the lines 24A, 26A, 28A in FIG. 1.

In this preferred embodiment, the inner portion 18 includes first, second and third sections or lobes 30, 32, 34, which are generally bell-shaped in the flat and inflated states. As best shown in FIG. 1, the sections 30, 32, 34 are equally disposed about, and extend outwardly from, the central region 20. In the inflated and assembled states, the sections 30, 32 cooperate to define the first vertical face 24; sections 32, 34 cooperate to define the second vertical face 26; and sections 30, 34 cooperate to define the third vertical face 28.

The first section 30 includes an inflation stem or port 36. Once the balloon structure 10 is inflated, the stem 36 may be closed by a heat seal in a conventional manner. In this preferred embodiment, a conventional self-sealing valve 38 (shown in phantom in FIG. 1) is positioned within the stem 36. One such self-sealing valve is shown in U.S. Pat. No. 4,917,646, and the teachings thereof are incorporated by reference.

The inflation fluid passes through the first section 30 into the second and third sections 32, 34 through first and second internal passageways 40, 42, respectively. In this preferred embodiment, the second and third sections 32, 34 are also in fluid communication through a third passageway 44.

The balloon structure 10 further includes first, second and third inflatable outer portions 46, 48, 50, in communication with the inflatable inner portion 18. Communication is via first, second and third umbilical portions 52, 54, 56, respectively. More particularly, the first, second and third umbilical portions 52, 54, 56 are interconnected to the first, second and third sections 30, 32, 34, respectively.

In this preferred embodiment, the inflatable outer portions 46, 48, 50 are substantially identical, and thus only the first outer portion 46 will be described in detail. The outer portion 46 includes a primary, or central, substantially circular section 58, in direct communication with the inner portion 18. Two secondary star-shaped sections 60, 62 are appended to, and in communication with, the primary section 58. The outer portion 46, or more particularly, the primary and secondary sections 58, 60, 62 define a message face 64, which is substantially horizontal and adjacent the tabletop 12 in the inflated state. The message face 64 preferable includes printed matter (not shown) representing the centerpiece theme (e.g., "Happy Birthday"). The balloon 10 further includes two strips 65, 66 of double-sided adhesive tape, affixed to the primary section 58 opposite the message face 64, adjacent the first umbilical portion 52.

Referring now to FIGS. 3 and 4, the inflatable outer portions 46, 48, 50 are rotated about a fold or crimp in the first, second and third umbilical portions 52, 54, 56, respectively. So rotated, each message face 64 is substantially vertical and exposed. The outer portions 46, 48, 50 are secured to the inner portion 18 by means of the tape strips 65, 66. More particularly, by folding the umbilical portions 52, 54, 56, the outer portions 46, 48, 50 engage and are affixed to the vertical faces 24, 26, 28, defined by the inner portion 18.

Figure 5:
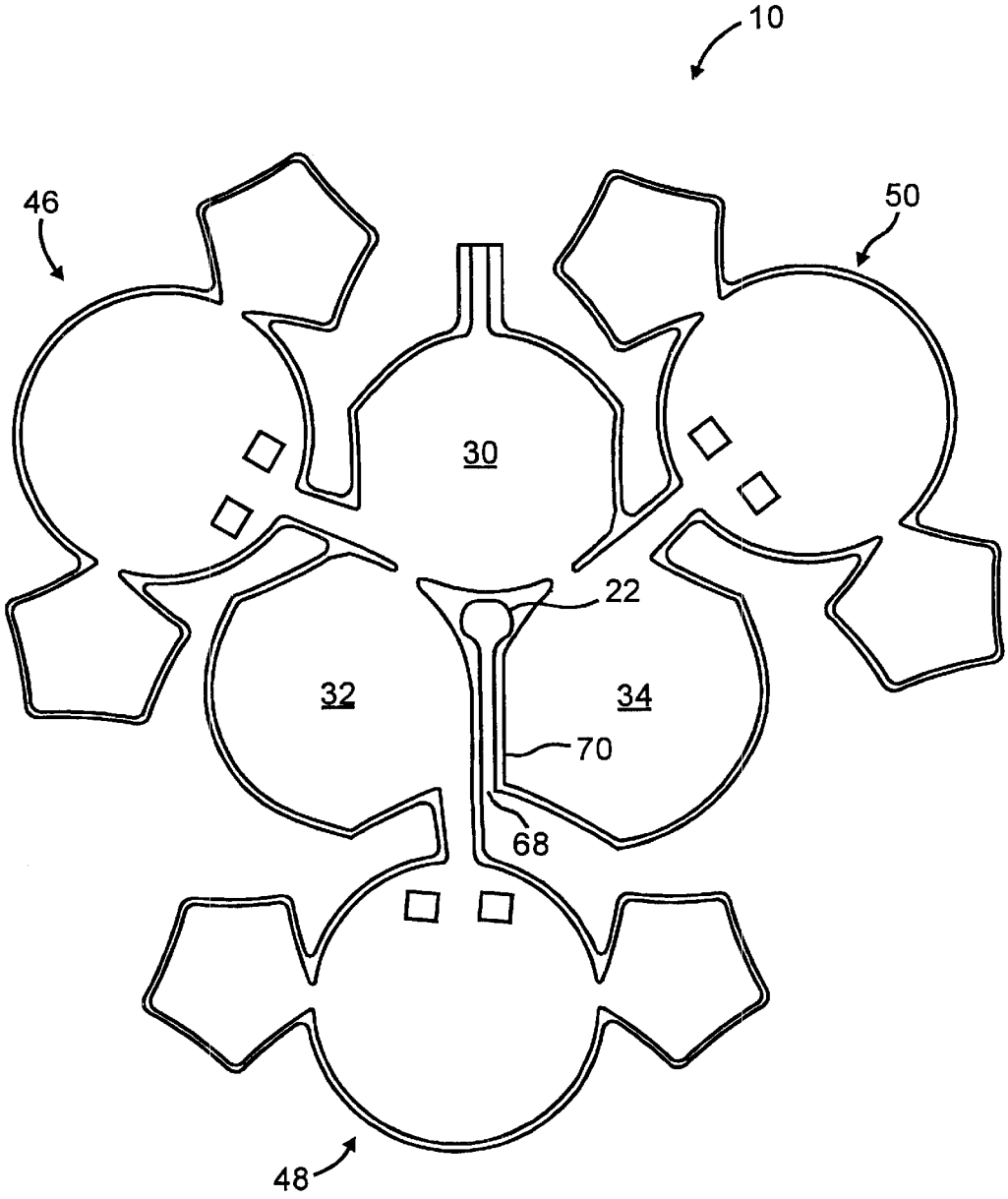
FIG. 5 is a top view illustrating a second preferred embodiment of the present invention in the flat state.

With regard to FIG. 5, a second preferred embodiment of the present invention is shown. Here, the inflatable inner portion 18 of the balloon structure 10 has a slot 68, extending outwardly from the central region 20 interposed the second and third sections 32, 34. The slot 68 facilitates use of the balloon centerpiece 10 with another decorative device, such as a centerpiece cascade. In this preferred embodiment, the second and third sections 32, 34 are not in fluid communication.

With reference now to FIGS. 1 and 5, the two flexible sheets of plastic 14, 16 are secured by a primary peripheral heat seal 70. In the first preferred embodiment of FIGS. 1–4, three interior seals 70A, 70B, 70C extend inwardly from the decorative device, such as a centerpiece cascade. In this preferred embodiment, the second and third sections 32, 34 are not in fluid communication.

With reference now to FIGS. 1 and 5, the two flexible sheets of plastic 14, 16 are secured by a primary peripheral heat seal 70. In the first preferred embodiment of FIGS. 1–4, three interior seals 70A, 70B, 70C extend inwardly from the peripheral heat seal 70, towards the apexes of the central triangular region 20. The interior seals 70A, 70B, 70C are extensions of the portions of the peripheral heat seal 70 that partially define the first, second and third umbilical portions 52, 54, 56. The interior seals 70A, 70B, 70C provide structural integrity and pressure relief, substantially avoiding rupture and/or twisting of the inner portion 18 upon inflation and assembly. As such, the inner portion 18 maintains a flat configuration in the inflated and assembled states. The interior seals 70A, 70B, 70C further define the first, second and third internal passageways 40, 42, 44, respectively. In the second preferred embodiment shown in FIG. 5, the peripheral seal 70 extends inwardly to the triangular region 20, thereby defining the slot 68 and replacing the interior seal 70B.

Preferred embodiments of the present invention have been described in detail. It is to be understood, however, that changes and modifications can be made without departing from the true scope and spirit of the invention as defined by the following claims, which are to be construed and interpreted in view of the foregoing.

What is claimed is:

1. A non-latex balloon having a flat state and an assembled state comprising:

an inflatable inner portion;

at least first, second and third inflatable outer portions in communication with said inflatable inner portion via first, second and third umbilical portions, respectively, said first, second and third inflatable outer portions having a first, second and third message face, respectively, said first, second and third umbilical portions extending outwardly from said inflatable inner portion in said flat state, said first, second and third umbilical portions being folded in said assembled state; and an inflation port in communication with said inflatable inner portion;

said first, second and third inflatable outer portions being secured to said inflatable inner portion in said assembled state, said first, second and third message faces being substantially vertical in said assembled state;

said inflatable inner portion being substantially triangular and including first, second and third sections defining a center region, said first section communicating with said second and third sections;

said first, second and third umbilical portions communicating with said first, second and third sections, respectively;

said central region having a central aperture.

2. An integral non-latex balloon as claimed in claim 1 wherein said inflatable inner portion defines a slot extending outwardly from said central aperture.

* * * * *